US012082652B2

(12) United States Patent
Peyton

(10) Patent No.: US 12,082,652 B2
(45) **Date of Patent: *Sep. 10, 2024**

(54) ARTICLE OF FOOTWEAR HAVING A SOLE STRUCTURE WITH PERIMETER AND CENTRAL CHAMBERS

(71) Applicant: NIKE, Inc., Beaverton, OR (US)

(72) Inventor: Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 355 days.

This patent is subject to a terminal disclaimer.

(21) Appl. No.: 17/367,022

(22) Filed: Jul. 2, 2021

(65) Prior Publication Data

US 2021/0330022 A1 Oct. 28, 2021

Related U.S. Application Data

(60) Continuation of application No. 15/825,799, filed on Nov. 29, 2017, now Pat. No. 11,051,578, which is a (Continued)

(51) Int. Cl.
*A43B 5/00* (2022.01)
*A43B 7/14* (2022.01)

(Continued)

(52) U.S. Cl.
CPC ..... *A43B 7/144* (2013.01); *A43B 13/187* (2013.01); *A43B 13/188* (2013.01); *A43B 13/20* (2013.01);

(Continued)

(58) Field of Classification Search
None
See application file for complete search history.

(56) References Cited

U.S. PATENT DOCUMENTS 2,677,906 A 5/1954 Reed
2,703,770 A 3/1955 Melzer (Continued)

FOREIGN PATENT DOCUMENTS

CN 1115624 A 1/1996
CN 100434005 C 11/2008

OTHER PUBLICATIONS

Office Action dated Aug. 15, 2014 in Chinese Patent Application No. 201080027258.0.

(Continued)

*Primary Examiner* — Jila M Mohandesi
(74) *Attorney, Agent, or Firm* — Honigman LLP; Matthew H. Szalach; Jonathan P. O'Brien

(57) ABSTRACT

An article of footwear is disclosed below as having an upper and a sole structure secured to the upper. The sole structure includes a perimeter chamber, a central chamber, and an outsole. The perimeter chamber extends adjacent to at least a portion of a lateral sidewall and a medial sidewall of the sole structure. The central chamber is positioned within a central area of the sole structure, the central area being located between the lateral sidewall and the medial sidewall. The outsole defines at least a portion of a lower surface of the sole structure, and has a perimeter section secured below the perimeter chamber and a central section secured below the central chamber. Various features may be incorporated into the sole structure. For example, the perimeter chamber may be spaced from the central chamber and the perimeter section may be spaced from the central section to define a gap extending upward and into the sole structure from the lower surface.

20 Claims, 13 Drawing Sheets

Related U.S. Application Data continuation of application No. 14/181,113, filed on Feb. 14, 2014, now Pat. No. 9,854,868, which is a division of application No. 12/491,973, filed on Jun. 25, 2009, now Pat. No. 8,650,775.

(51) Int. Cl.

| | |
|---|---|
| ***A43B 7/144*** | (2022.01) |
| ***A43B 13/18*** | (2006.01) |
| ***A43B 13/20*** | (2006.01) |
| ***A43B 21/28*** | (2006.01) |

(52) U.S. Cl.

CPC ..... *A43B 13/203* (2013.01); *A43B 21/28* (2013.01); *A43B 21/285* (2013.01)

(56) References Cited

U.S. PATENT DOCUMENTS 2,762,134 A * 9/1956 Town ..... A43B 17/03 36/153
3,030,640 A 4/1962 Gosman
3,608,215 A 9/1971 Fukuoka
3,685,176 A 8/1972 Rudy
3,758,964 A 9/1973 Nishimura
4,183,156 A * 1/1980 Rudy ..... A43B 13/40 36/44
4,187,620 A 2/1980 Selner
4,217,705 A 8/1980 Donzis
4,219,945 A 9/1980 Rudy
4,358,902 A 11/1982 Cole et al.
4,486,964 A * 12/1984 Rudy ..... A43B 13/18 36/38
4,506,460 A 3/1985 Rudy
4,547,919 A 10/1985 Wang
4,577,417 A 3/1986 Cole
4,698,864 A 10/1987 Graebe
4,722,131 A 2/1988 Huang
4,782,602 A 11/1988 Lakic
4,803,029 A 2/1989 Iversen et al.
4,817,304 A 4/1989 Parker et al.
4,823,482 A 4/1989 Lakic
4,845,861 A 7/1989 Moumdjian
4,874,640 A 10/1989 Donzis
4,891,855 A 1/1990 Cheng-Chung
4,906,502 A 3/1990 Rudy
4,912,861 A 4/1990 Huang
4,936,029 A 6/1990 Rudy
4,991,317 A 2/1991 Lakic
4,999,931 A 3/1991 Vermeulen
5,005,575 A 4/1991 Geri
5,022,109 A 6/1991 Pekar
5,025,575 A 6/1991 Lakic
5,042,176 A 8/1991 Rudy
5,044,030 A 9/1991 Balaton
5,158,767 A 10/1992 Cohen et al.
5,179,792 A 1/1993 Brantingham
5,193,246 A 3/1993 Huang
5,199,191 A 4/1993 Moumdjian
5,224,277 A * 7/1993 Sang Do ..... A43B 7/082 36/3 R
5,224,278 A 7/1993 Jeon
5,228,156 A 7/1993 Wang
5,235,715 A 8/1993 Donzis
5,245,766 A 9/1993 Warren
5,253,435 A 10/1993 Auger et al.
5,257,470 A 11/1993 Auger et al.
5,313,717 A * 5/1994 Allen et al. ..... 36/28
5,335,382 A 8/1994 Huang
5,337,492 A 8/1994 Anderie et al.
5,353,459 A * 10/1994 Potter ..... A43B 17/03 36/71
5,367,791 A 11/1994 Gross et al.
5,406,719 A 4/1995 Potter
5,493,792 A 2/1996 Bates et al.
5,524,364 A * 6/1996 Cole ..... A43B 13/189 36/35 B
5,572,804 A 11/1996 Skaja et al.
5,592,706 A 1/1997 Pearce
5,595,004 A 1/1997 Lyden et al.
5,669,161 A 9/1997 Huang
5,686,167 A 11/1997 Rudy
5,704,137 A 1/1998 Dean et al.
5,713,141 A 2/1998 Mitchell et al.
5,741,568 A 4/1998 Rudy
5,755,001 A 5/1998 Potter et al.
5,771,606 A 6/1998 Litchfield et al.
5,794,359 A 8/1998 Jenkins et al.
5,832,630 A 11/1998 Potter
5,846,063 A 12/1998 Lakic
5,907,911 A 6/1999 Huang
5,916,664 A 6/1999 Rudy
5,925,306 A 7/1999 Huang
5,952,065 A 9/1999 Mitchell et al.
5,976,451 A 11/1999 Skaja et al.
5,979,078 A 11/1999 McLaughlin
5,993,585 A 11/1999 Goodwin et al.
6,009,637 A 1/2000 Pavone
6,013,340 A 1/2000 Bonk et al.
6,027,683 A 2/2000 Huang
6,029,962 A 2/2000 Shorten et al.
6,061,929 A 5/2000 Ritter
6,065,150 A 5/2000 Huang
6,082,025 A 7/2000 Bonk et al.
6,098,313 A 8/2000 Skaja
6,127,010 A 10/2000 Rudy
6,127,026 A 10/2000 Bonk et al.
6,128,837 A 10/2000 Huang
6,192,606 B1 2/2001 Pavone
6,203,868 B1 3/2001 Bonk et al.
6,253,466 B1 7/2001 Harmon-Weiss et al.
6,258,421 B1 7/2001 Potter
6,266,897 B1 * 7/2001 Seydel ..... A43B 13/16 36/25 R
6,321,465 B1 11/2001 Bonk et al.
D451,264 S 12/2001 Marvin et al.
D453,988 S 3/2002 Smith et al.
6,374,514 B1 4/2002 Swigart
6,385,864 B1 5/2002 Sell, Jr. et al.
6,402,879 B1 6/2002 Tawney et al.
6,430,843 B1 8/2002 Potter et al.
6,457,262 B1 * 10/2002 Swigart ..... A43B 13/206 36/35 B
6,463,612 B1 10/2002 Potter
6,516,540 B2 2/2003 Seydel et al.
6,550,085 B2 4/2003 Roux
6,571,490 B2 6/2003 Tawney et al.
6,589,614 B2 * 7/2003 Stubblefield ..... A43B 13/20 36/35 B
6,665,958 B2 12/2003 Goodwin
6,754,981 B1 * 6/2004 Edwards ..... A43B 7/1445 36/3 R
6,763,612 B2 * 7/2004 Stubblefield ..... A43B 13/20 36/35 R
6,783,184 B2 8/2004 DiBattista et al.
6,796,056 B2 9/2004 Swigart
6,837,951 B2 1/2005 Rapaport
6,892,477 B2 5/2005 Potter et al.
6,918,198 B2 7/2005 Chi
6,931,764 B2 8/2005 Swigart et al.
6,971,193 B1 * 12/2005 Potter ..... A43B 13/203 36/141
7,000,335 B2 2/2006 Swigart et al.
7,020,988 B1 * 4/2006 Holden et al. ..... 36/35 B
7,051,456 B2 5/2006 Swigart et al.
7,070,845 B2 7/2006 Thomas et al.
7,076,891 B2 7/2006 Goodwin
7,086,179 B2 8/2006 Dojan et al.
7,086,180 B2 8/2006 Dojan et al.
7,128,796 B2 10/2006 Hensley et al.
7,131,218 B2 11/2006 Schindler
7,132,032 B2 11/2006 Tawney et al.
7,141,131 B2 11/2006 Foxen et al.
7,181,867 B2 2/2007 Litchfield et al.

(56) References Cited

U.S. PATENT DOCUMENTS

| | | | | |
|---|---|---|---|---|
| 7,200,957 | B2 | 4/2007 | Hubbard et al. | |
| 7,244,483 | B2 | 7/2007 | Tawney et al. | |
| 7,249,425 | B2 * | 7/2007 | Wang | A43B 7/144 36/44 |
| 7,278,226 | B2 * | 10/2007 | Holden et al. | 36/35 R |
| 7,451,554 | B2 | 11/2008 | Hazenberg et al. | |
| 7,475,498 | B2 | 1/2009 | Litchfield et al. | |
| 7,555,848 | B2 | 7/2009 | Aveni et al. | |
| 7,555,851 | B2 | 7/2009 | Hazenberg et al. | |
| 7,810,255 | B2 | 10/2010 | Schindler et al. | |
| 7,832,118 | B2 * | 11/2010 | Holden et al. | 36/35 R |
| 7,877,900 | B2 | 2/2011 | Russell | |
| 7,946,059 | B2 | 5/2011 | Borel | |
| 7,966,750 | B2 | 6/2011 | Schindler et al. | |
| 8,225,533 | B2 * | 7/2012 | Meschan | A43B 21/26 36/35 R |
| 8,650,775 | B2 | 2/2014 | Peyton | |
| 2006/0236563 | A1 * | 10/2006 | Wang | A43B 13/20 36/29 |
| 2010/0325914 | A1 | 12/2010 | Peyton | |
| 2011/0005101 | A1 | 1/2011 | Sills | |

OTHER PUBLICATIONS

Response to Office Action dated Aug. 25, 2014 in European Patent Application No. 10745032.2.
Response to Office Action dated Dec. 30, 2014 in Chinese Patent Application No. 201080027258.0.
Office Action dated Dec. 30, 2013 in Chinese Patent Application No. 201080027258.0.
Response to Office Action dated May 14, 2014 in Chinese Patent Application No. 201080027258.0.
Office Action dated Apr. 23, 2014 in European Patent Application No. 10745032.2.
International Search Report and Written Opinion mailed Feb. 24, 2011 in PCT/US2010/039839.
USPTO, Final Office Action mailed Jun. 11, 2012 for U.S. Appl. No. 12/491,973.
USPTO, Non-Final Office Action mailed Mar. 6, 2012 for U.S. Appl. No. 12/491,973.
USPTO, Non-Final Office Action mailed Mar. 31, 2017 for U.S. Appl. No. 14/181,113.
USPTO, Final Office Action mailed Oct. 25, 2016 for U.S. Appl. No. 14/181,113.
USPTO, Non-Final Office Action mailed Jun. 1, 2016 for U.S. Appl. No. 14/181,113.
European Patent Office, Extended European Search Report for EP Application No. 18181204.1 mailed Oct. 25, 2018.
European Patent Office, Extended EP Search Report for EP Application No. 19211252.2, mailed Mar. 20, 2020.
USPTO Non-Final Office Action for U.S. Appl. No. 15/825,799 dated Oct. 25, 2019.
USPTO Final Office Action for U.S. Appl. No. 15/825,799 dated May 1, 2020.
USPTO Non-Final Office Action for U.S. Appl. No. 15/825,799 dated Aug. 31, 2020.

* cited by examiner

ARTICLE OF FOOTWEAR HAVING A SOLE STRUCTURE WITH PERIMETER AND CENTRAL CHAMBERS

CROSS-REFERENCE TO RELATED APPLICATION(S)

This application is a continuation of application Ser. No. 15/825,799, filed Nov. 29, 2017, which is a continuation of application Ser. No. 14/181,113, filed Feb. 14, 2014, (now U.S. Pat. No. 9,854,868, issued Jan. 2, 2018), which is a divisional of application Ser. No. 12/491,973, filed Jun. 25, 2009, (now U.S. Pat. No. 8,650,775, issued Feb. 18, 2014), the entire disclosures of which are hereby incorporated by reference.

BACKGROUND

Conventional articles of athletic footwear include two primary elements, an upper and a sole structure. The upper is generally formed from a plurality of elements (e.g., textiles, foam, leather, synthetic leather) that are stitched or adhesively bonded together to form an interior void for securely and comfortably receiving a foot. The sole structure incorporates multiple layers that are conventionally referred to as a sockliner, a midsole, and an outsole. The sockliner is a thin, compressible member located within the void of the upper and adjacent to a plantar (i.e., lower) surface of the foot to enhance comfort. The midsole is secured to the upper and forms a middle layer of the sole structure that attenuates ground reaction forces (i.e., imparts cushioning) during walking, running, or other ambulatory activities. The outsole forms a ground-contacting element of the footwear and is usually fashioned from a durable and wear-resistant rubber material that includes texturing to impart traction.

The primary material forming many conventional midsoles is a polymer foam, such as polyurethane or ethylvinylacetate. In some articles of footwear, the midsole may also incorporate a fluid-filled chamber that increases durability of the footwear and enhances ground reaction force attenuation of the sole structure. In some footwear configurations, the fluid-filled chamber may be at least partially encapsulated within the polymer foam, as in U.S. Pat. No. 5,755,001 to Potter, et al., U.S. Pat. No. 6,837,951 to Rapaport, and U.S. Pat. No. 7,132,032 to Tawney, et al. In other footwear configurations, the fluid-filled chamber may substantially replace the polymer foam, as in U.S. Pat. No. 7,086,180 to Dojan, et al. In general, the fluid-filled chambers are formed from a polymer material that is sealed and pressurized, but may also be substantially unpressurized or pressurized by an external source. In some configurations, textile or foam tensile members may be located within the chamber, or reinforcing structures may be bonded to an exterior surface of the chamber to impart shape to or retain an intended shape of the chamber.

Fluid-filled chambers suitable for footwear applications may be manufactured through various processes, including a two-film technique, thermoforming, and blowmolding. In the two-film technique, two planar sheets of polymer material are bonded together in various locations to form the chamber. In order to pressurize the chamber, a nozzle or needle connected to a fluid pressure source is inserted into a fill inlet formed in the chamber. Following pressurization, the fill inlet is sealed and the nozzle is removed. Thermoforming is similar to the two-film technique, but utilizes a heated mold that forms or otherwise shapes the sheets of polymer material during the manufacturing process. In blowmolding, a molten or otherwise softened elastomeric material in the shape of a tube (i.e., a parison) is placed in a mold having the desired overall shape and configuration of the chamber. The mold has an opening at one location through which pressurized air is provided. The pressurized air induces the liquefied elastomeric material to conform to the shape of the inner surfaces of the mold, thereby forming the chamber, which may then be pressurized.

SUMMARY

An article of footwear is disclosed below as having an upper and a sole structure secured to the upper. The sole structure includes a perimeter chamber, a central chamber, and an outsole. The perimeter chamber extends adjacent to at least a portion of a lateral sidewall and a medial sidewall of the sole structure. The central chamber is positioned within a central area of the sole structure, the central area being located between the lateral sidewall and the medial sidewall. The outsole defines at least a portion of a lower surface of the sole structure, and has a perimeter section secured below the perimeter chamber and a central section secured below the central chamber, Various features may be incorporated into the sole structure. For example, the perimeter chamber may be spaced from the central chamber and the perimeter section may be spaced from the central section to define a gap extending upward and into the sole structure from the lower surface.

Also, an article of footwear is disclosed below as having an upper and a sole structure secured to the upper. The sole structure includes a perimeter element, a central element, and an outsole. The perimeter element extends adjacent to at least a portion of a lateral sidewall and a medial sidewall of the sole structure. The central element is positioned within a central area of the sole structure, the central area being located between the lateral sidewall and the medial sidewall. The outsole defines at least a portion of a lower surface of the sole structure, and has a perimeter section secured below the perimeter element and a central section secured below the central element. Various features may be incorporated into the sole structure. For example, the perimeter element may be spaced from the central element and the perimeter section may be spaced from the central section to define a gap extending upward and into the sole structure from the lower surface.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various sole structure configurations for articles of footwear. Concepts related to the sole structure configurations are disclosed with reference to footwear that is suitable for running. The sole structure configurations are not limited to footwear designed for running, however, and may be utilized with a wide range of athletic footwear styles, including basketball shoes, cross-training shoes, cycling shoes, football shoes, soccer shoes, tennis shoes, and walking shoes, for example. The sole structure configurations may also be utilized with footwear styles that are generally considered to be non-athletic, including dress shoes, loafers, sandals, and boots. The concepts disclosed herein may, therefore, apply to a wide variety of footwear styles, in addition to the specific style discussed in the following material and depicted in the accompanying figures.

General Footwear Structure

Figure 1:
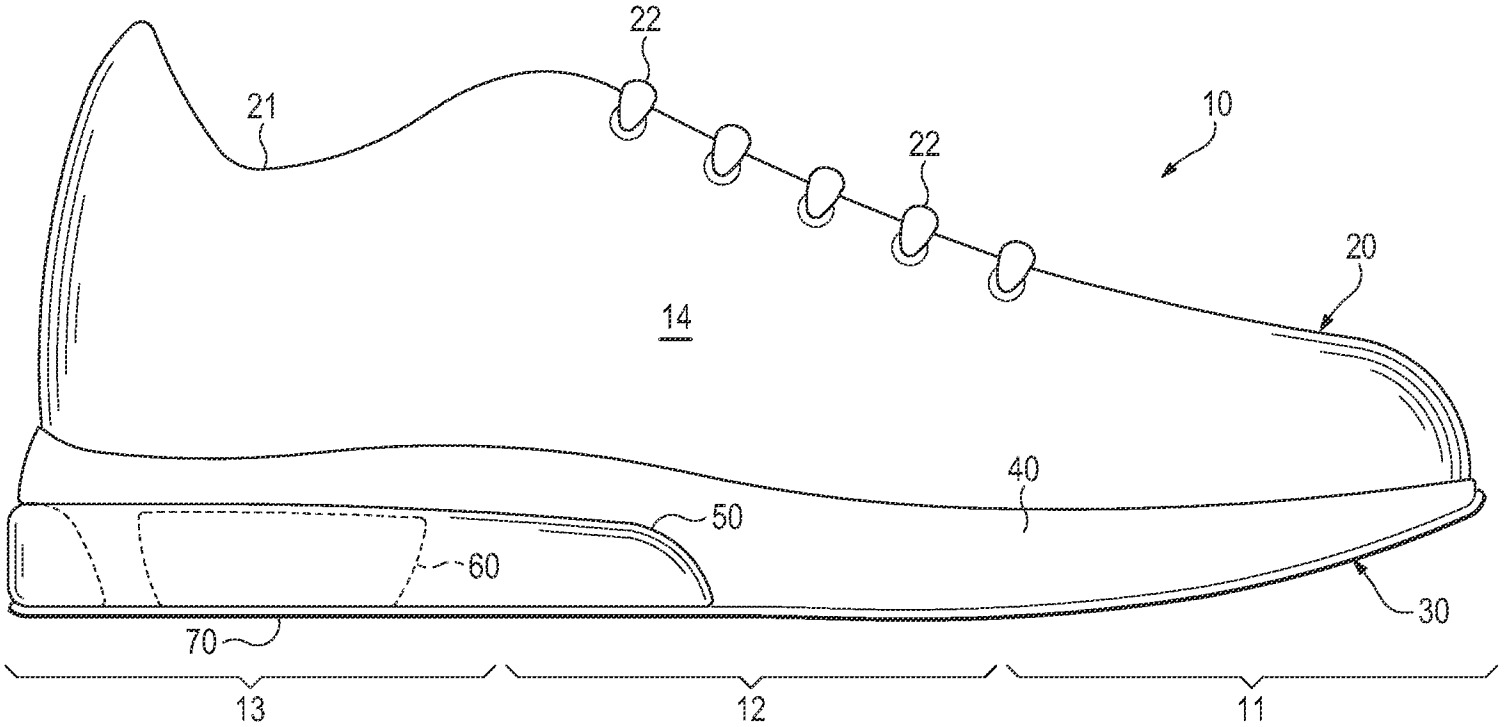
FIG. 1 is lateral side elevational view of an article of footwear.
Figure 2:
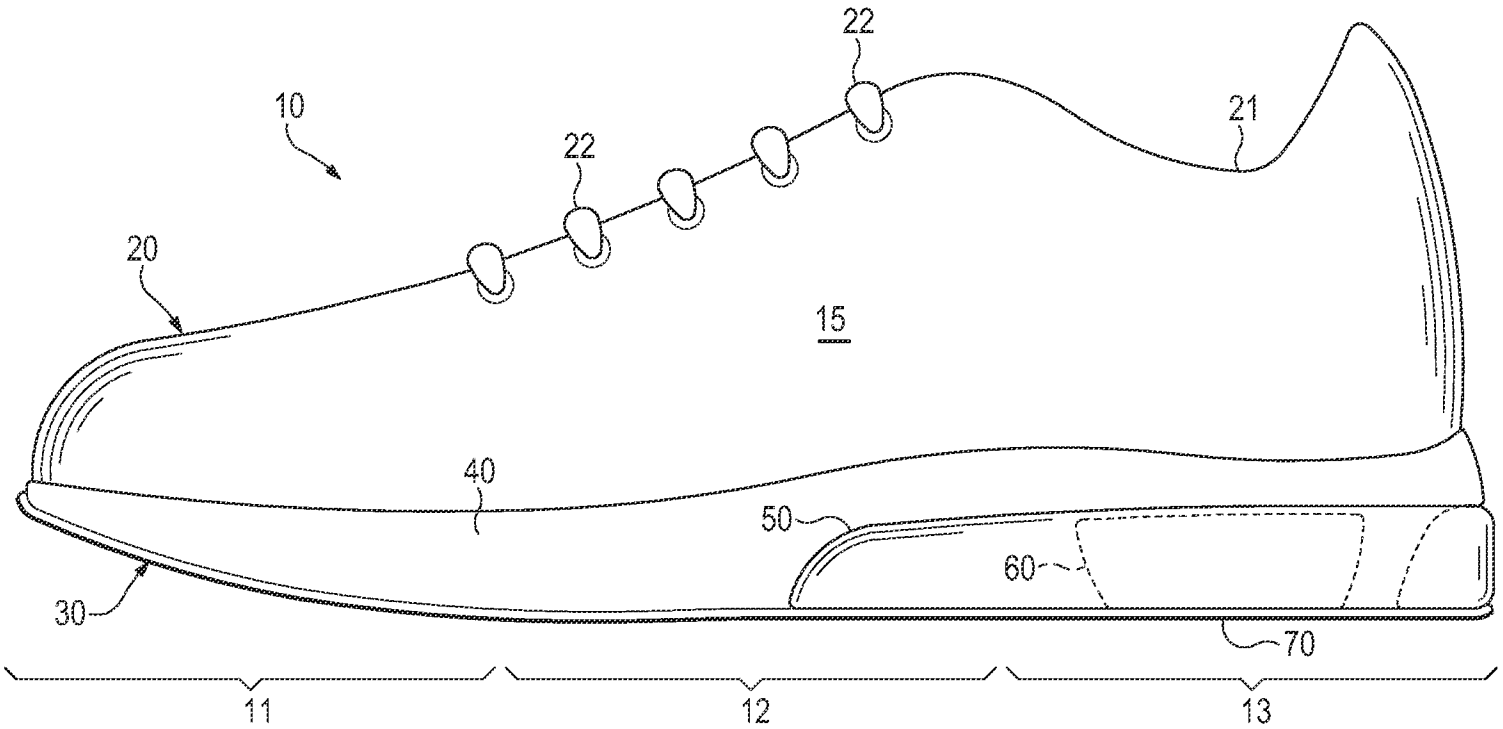
FIG. 2 is a medial side elevational view of the article of footwear.
Figure 3:
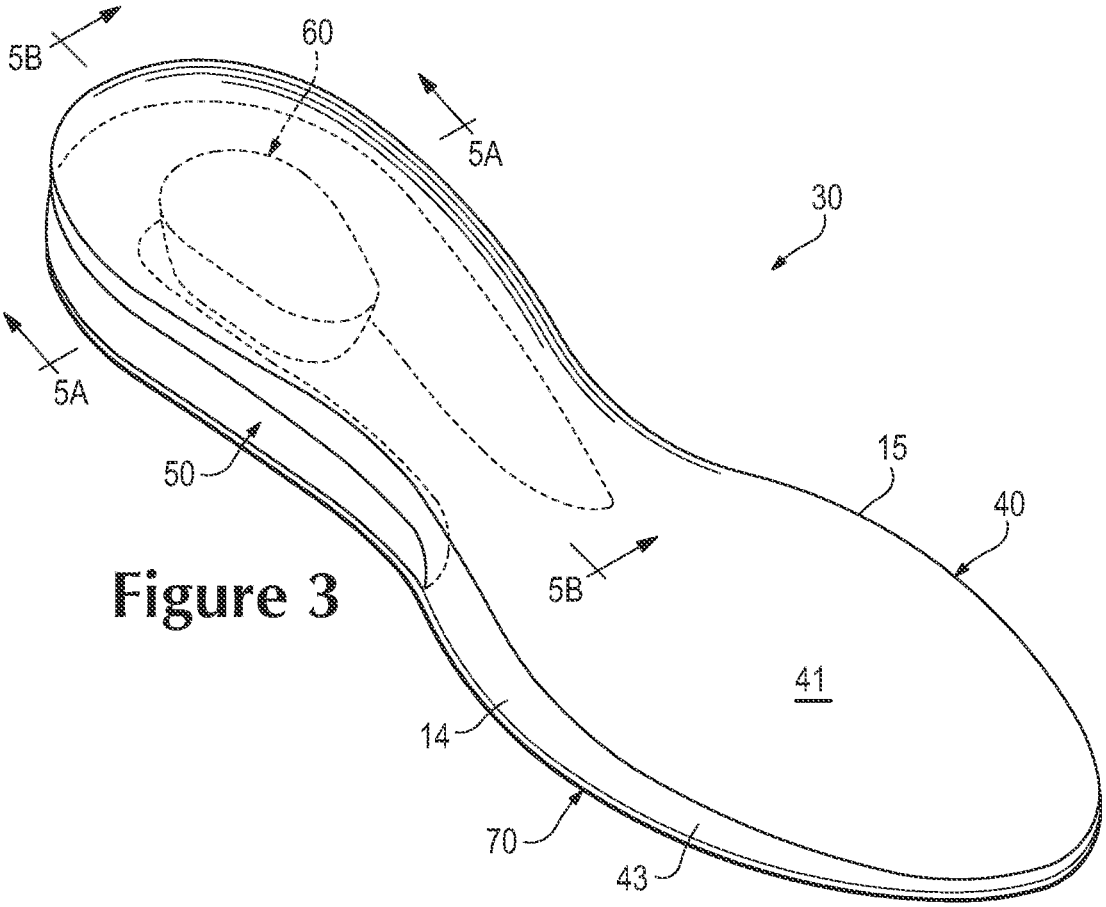
FIG. 3 is a perspective view of a sole structure of the article of footwear.
Figure 4:
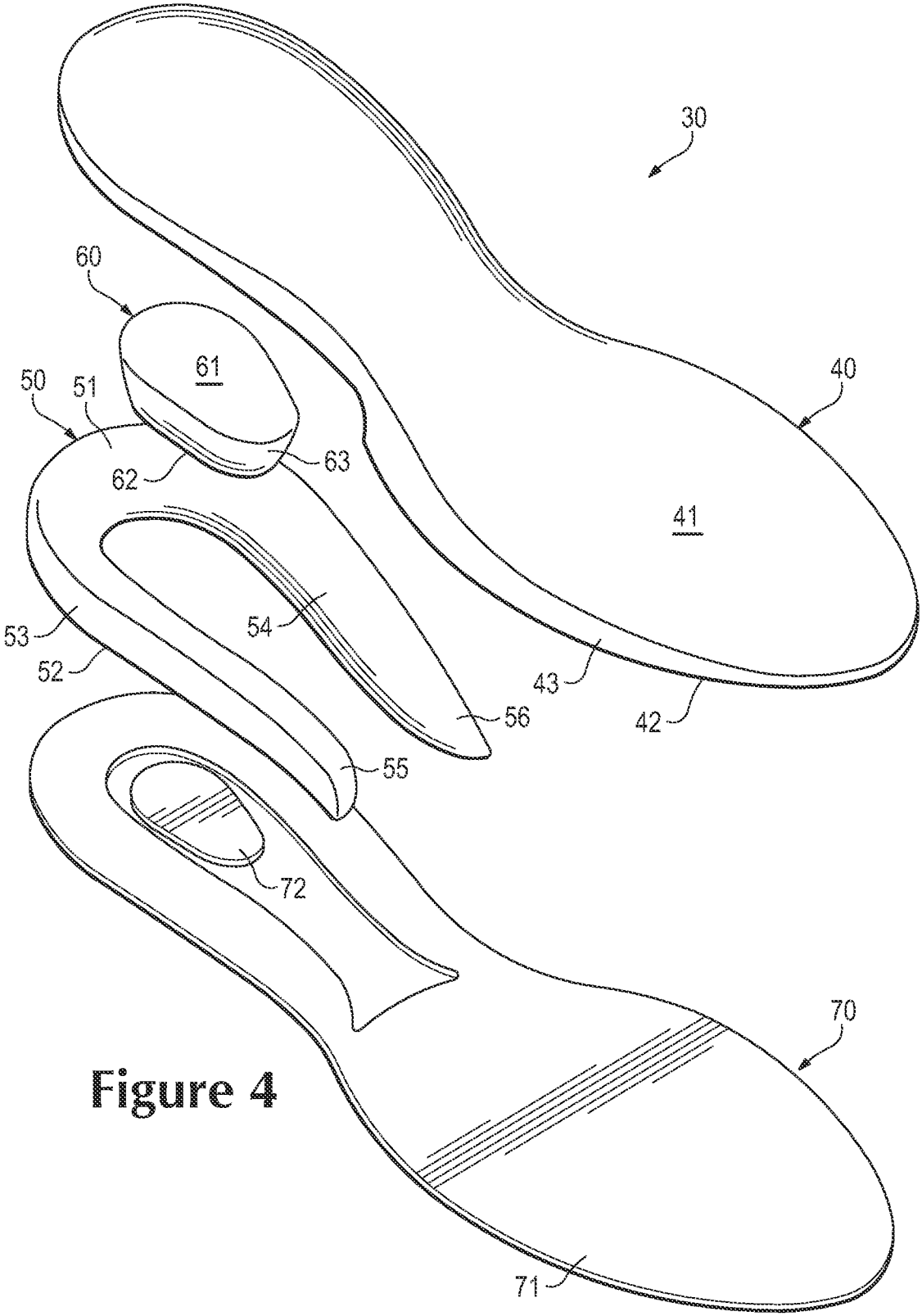
FIG. 4 is an exploded perspective view of the sole structure.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIGS. 1 and 2. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot, and heel region 13 corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10, Rather, regions 11-13 and sides 14-15 are intended to represent general areas of footwear 10 to aid in the following discussion. In addition to footwear 10, regions 11-13 and sides 14-15 may also be applied to upper 20, sole structure 30, and individual elements thereof.

Upper 20 is depicted as having a substantially conventional configuration incorporating a plurality material elements (e.g., textiles, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22. Given that various aspects of the present discussion primarily relate to sole structure 30, upper 20 may exhibit the general configuration discussed above or the general configuration of practically any other conventional or non-conventional upper. Accordingly, the structure of upper 20 may vary significantly within the scope of the present invention.

Sole structure 30 is secured to upper 20 and has a configuration that extends between upper 20 and the ground. In general, the various elements of sole structure 30 attenuate ground reaction forces imparts cushioning), affect the overall motion of the foot, and impart traction during walking, running, or other ambulatory activities. Additional details concerning the configuration of sole structure 30 will be described below.

Sole Structure Configuration

Sole structure 30 is depicted in FIGS. 3-5B and includes a midsole element 40, a perimeter chamber 50, a central chamber 60, and an outsole 70. In addition to these elements, sole structure 30 may incorporate one or more plates, moderators, or reinforcing structures, for example, that further enhance the ground reaction force attenuation characteristics of sole structure 30 or the performance properties of footwear 10. Additionally, sole structure 30 may incorporate a sockliner (not depicted) that is located with in a lower portion of the void in upper 20 to enhance the comfort of footwear 10.

Midsole element 40 extends throughout a length of footwear 10 (i.e., through each of regions 11-13) and a width of footwear 10 (i.e., between sides 14 and 15). The primary surfaces of midsole element 40 are an upper surface 41, an opposite lower surface 42, and a side surface 43 that extends between surfaces 41 and 42. Upper surface 41 is joined to a lower area of upper 20, thereby joining sole structure 30 to upper 20. Lower surface 42 is joined with outsole 70 in forefoot region 11 and portions of midfoot region 12, but is secured to each of perimeter chamber 50 and central chamber 60 in at least heel region 13. Additionally, side surface 43 forms a portion of an exposed sidewall of sole structure 30 on both lateral side 14 and medial side 15.

A variety of materials may be utilized to form midsole element 40. As an example, midsole element 40 may be formed from a polymer foam material, such as polyurethane or ethylvinylacetate, that enhances the ground reaction force attenuation characteristics of sole structure 30 during walking, running, or other ambulatory activities. In some configurations, midsole element 40 may also be (a) a plate formed from a semi-rigid polymer material or (b) a combination of a plate and foam material. In addition to the foam material, midsole element 40 may incorporate one or more plates, moderators, or reinforcing structures, for example, that further enhance the ground reaction force attenuation characteristics of sole structure 30 or the overall performance properties of footwear 10. In further configurations, midsole element 40 may also encapsulate a fluid-filled chamber in forefoot region 11. Accordingly, the materials and overall configuration of midsole element 40 may vary significantly.

Perimeter chamber 50 and central chamber 60 are shown together and in a proper spatial relationship in FIGS. 6-10B. Each of chambers 50 and 60 enclose fluids (i.e., either a gas, liquid, or gel) and may be pressurized. In general, perimeter chamber 50 is located at a perimeter of sole structure 30, whereas central chamber 60 is located within a central area of sole structure 30. Although chambers 50 and 60 may contact each other or may be formed as a single unit in some configurations of footwear 10, a gap 31 generally extends between portions of chambers 50 and 60. As discussed in greater detail below, an upper portion 32 of gap 31 is located closer to the sidewall of sole structure 30 than a lower portion 33 of gap 31. That is, gap 31 extends in a generally diagonal direction such that lower portion 33 is located closer to a center of sole structure 30 than upper portion 32.

Perimeter chamber 50 has a generally U-shaped configuration. The exterior of perimeter chamber 50 defines an upper surface 51, an opposite lower surface 52, an exterior side surface 53 that extends between one side of surfaces 51 and 52, and an interior side surface 54 that extends between an opposite side of surfaces 51 and 52. Additionally, perimeter chamber 50 has a lateral portion 55 located adjacent to lateral side 14 and an opposite medial portion 56 located adjacent to medial side 15. When incorporated into sole structure 30, upper surface 51 is secured to lower surface 42 of midsole element 40, and lower surface 52 is secured to outsole 70. Although lateral portion 55 and medial portion 56 may have the same length and general dimensions (i.e., shape, height, thickness), the length and dimensions of lateral portion 55 and medial portion 56 may be different to vary the properties of sole structure 30 on sides 14 and 15. In some configurations, perimeter chamber 50 may also have various indentations or flex grooves that assist with enhancing the flexibility of sole structure 30 in specific areas.

Areas of perimeter chamber 50 extends around or adjacent to at least a portion of the perimeter of sole structure 30. More particularly, each of lateral portion 55 and medial portion 56 are exposed on the exterior of footwear 10. In this configuration, exterior side surface 53 extends along or adjacent to lateral side 14, extends around a rear area of heel region 13, and extends along or adjacent to medial side 15, thereby forming a portion of an exposed sidewall of sole structure 30 on lateral side 14 and medial side 15. In further configurations, however, perimeter chamber 50 may be spaced inward from the sidewall or may protrude outward significantly from the sidewall. Furthermore, although perimeter chamber 50 is depicted as extending into a portion of midfoot region 12, perimeter chamber 50 may be limited to heel region 13 or may extend throughout each of regions 11-13.

Central chamber 60 has a generally rounded configuration. The exterior of central chamber 60 defines an upper surface 61, an opposite lower surface 62, and a side surface 63. In general, central chamber 60 has a configuration wherein upper surface 61 has a greater area than lower surface 62, thereby causing side surface 63 to taper inward between surfaces 61 and 62. Moreover, upper surface 61 may have a shape that includes two rounded ends having different sizes. As such, central chamber 60 exhibits a general configuration of a fluid-filled bladder disclosed in U.S. Pat. No. 6,796,056 to Swigart, which is incorporated herein by reference. Within sole structure 30, upper surface 61 is secured to lower surface 42 of midsole element 40, and lower surface 62 is secured to outsole 70.

Central chamber 60 is located within the central area of sole structure 30, thereby being positioned between lateral portion 55 and medial portion 56 of perimeter chamber 50. At least a portion of central chamber 60 is spaced from perimeter chamber 50 to define gap 31 between central chamber 60 and perimeter chamber 50. Although chambers 50 and 60 may contact each other or may be formed as a single unit in some configurations of footwear 10, gap 31 generally extends between portions of chambers 50 and 60. For example, gap 31 may extend between at least central chamber 60 and areas of interior side surface 54 in lateral portion 55 and medial portion 56.

Figure 5A:
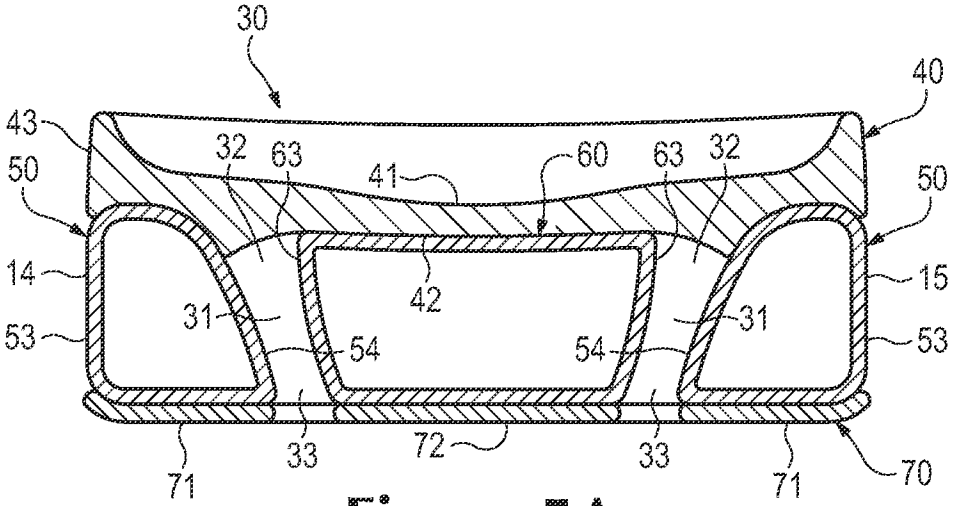
FIGS. 5A and 5B are cross-sectional views of the sole structure, as defined by section lines 5A and 5B in FIG. 3.
Figure 5B:
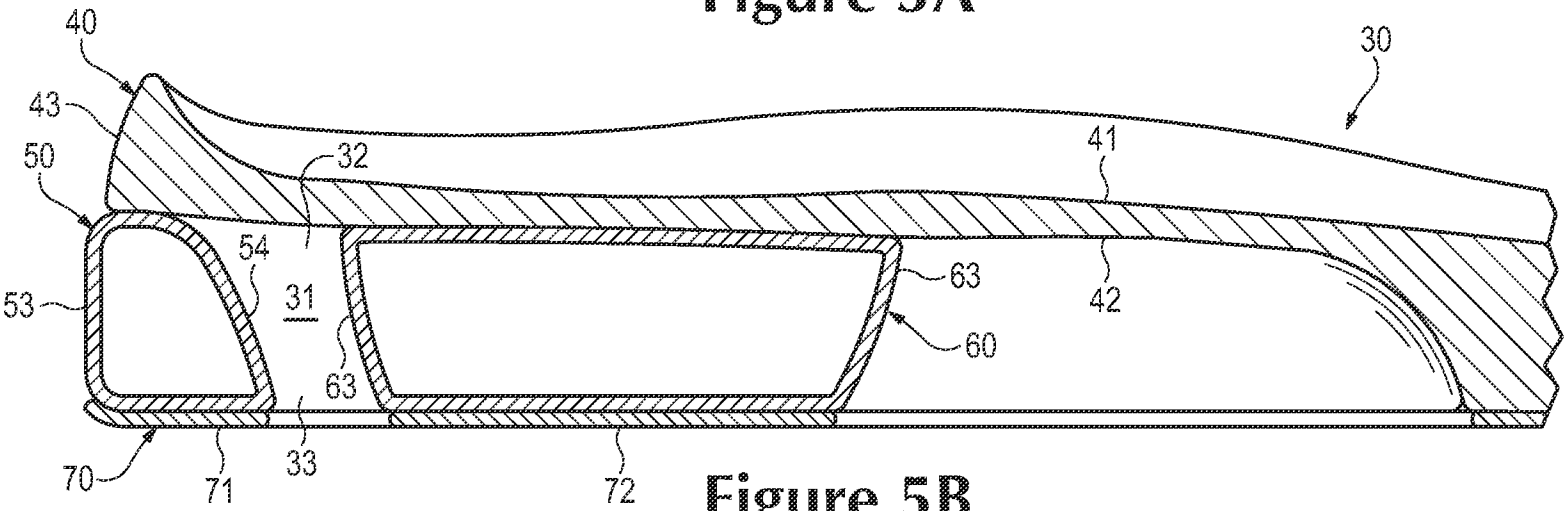
Figure 6:
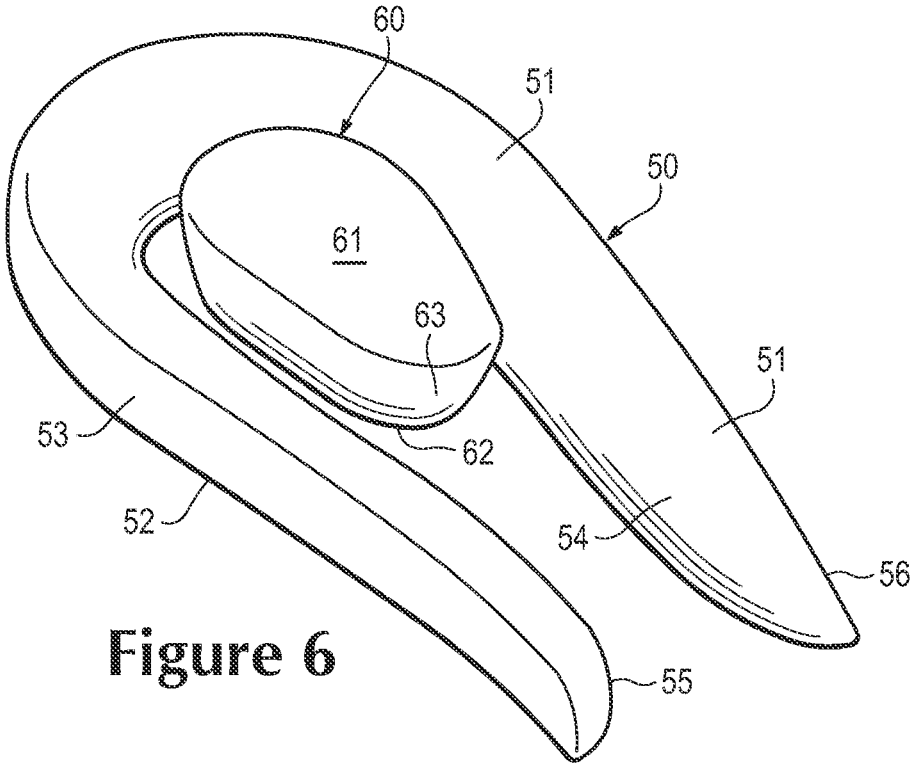
FIG. 6 is a perspective view of a perimeter chamber and a central chamber of the sole structure.
Figure 7:
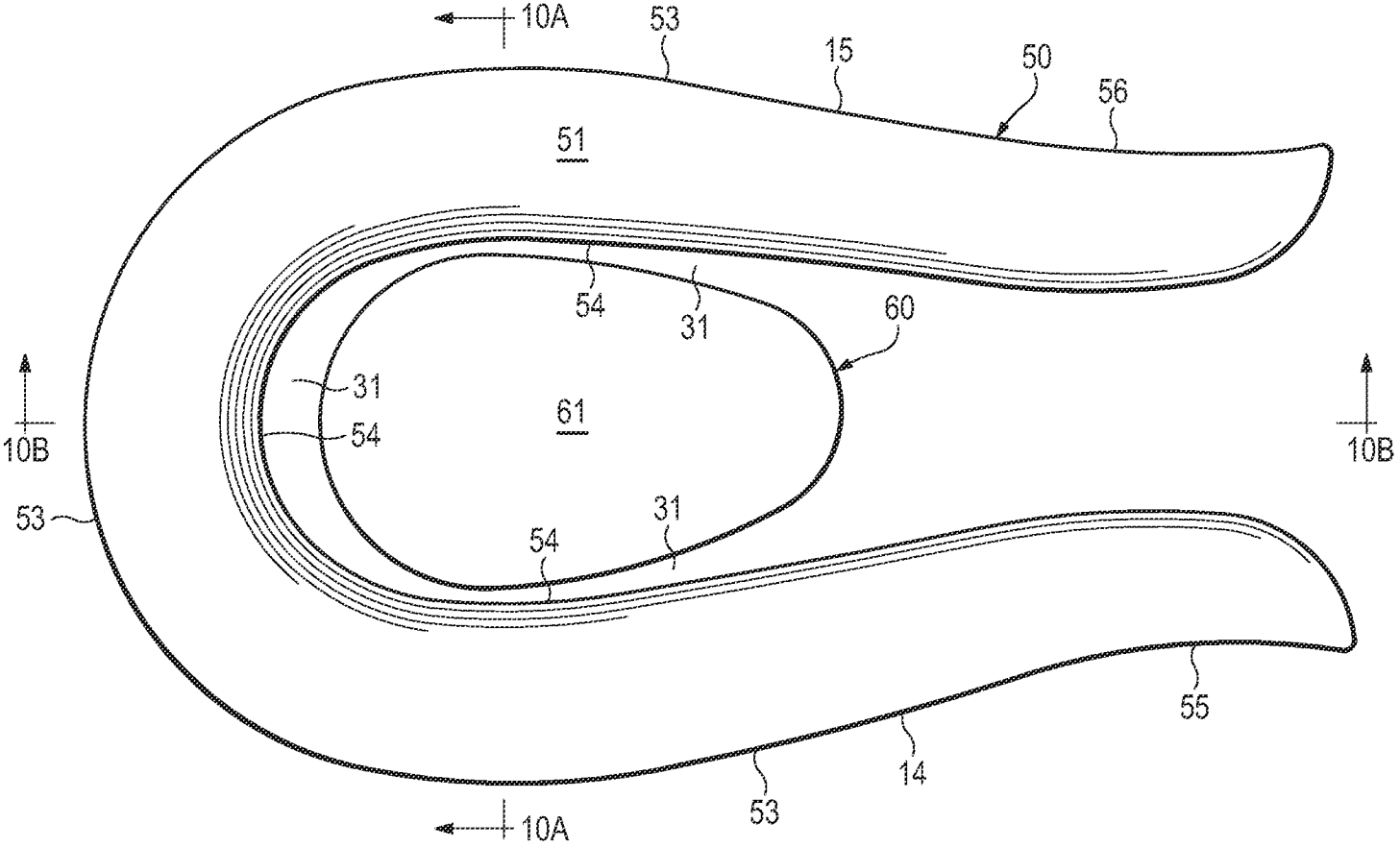
FIG. 7 is a top plan view of the perimeter chamber and the central chamber.
Figure 8:
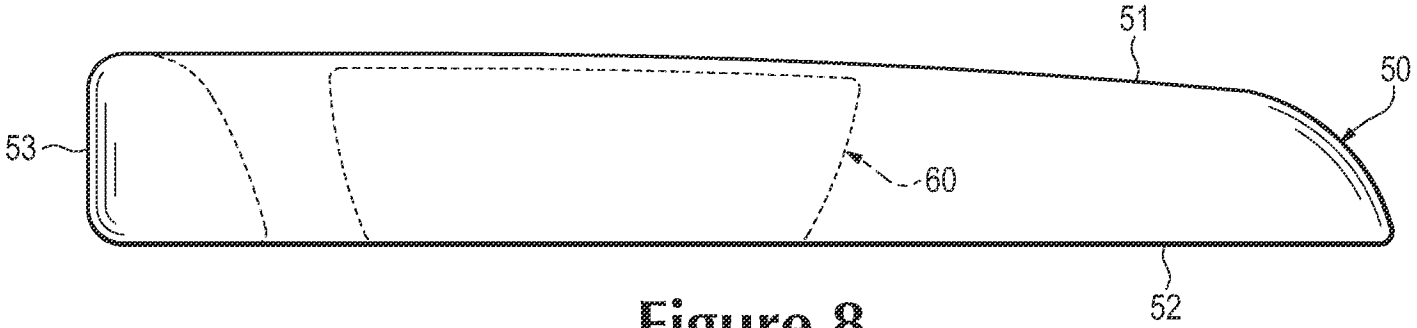
FIG. 8 is a side elevational view of the perimeter chamber and the central chamber.
Figure 9:
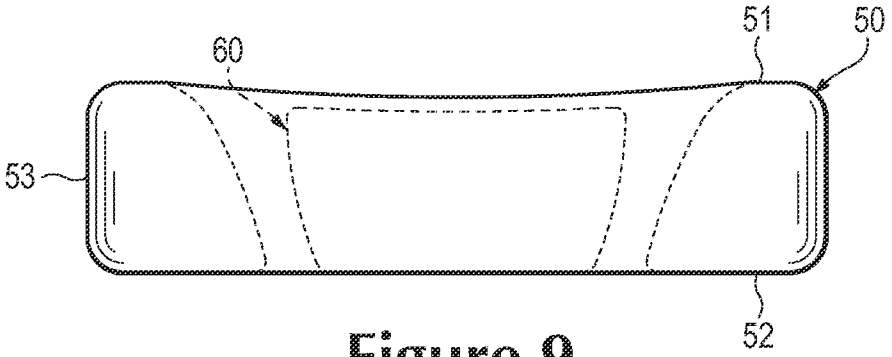
FIG. 9 is a rear elevational view of the perimeter chamber and the central chamber.
Figure 10A:
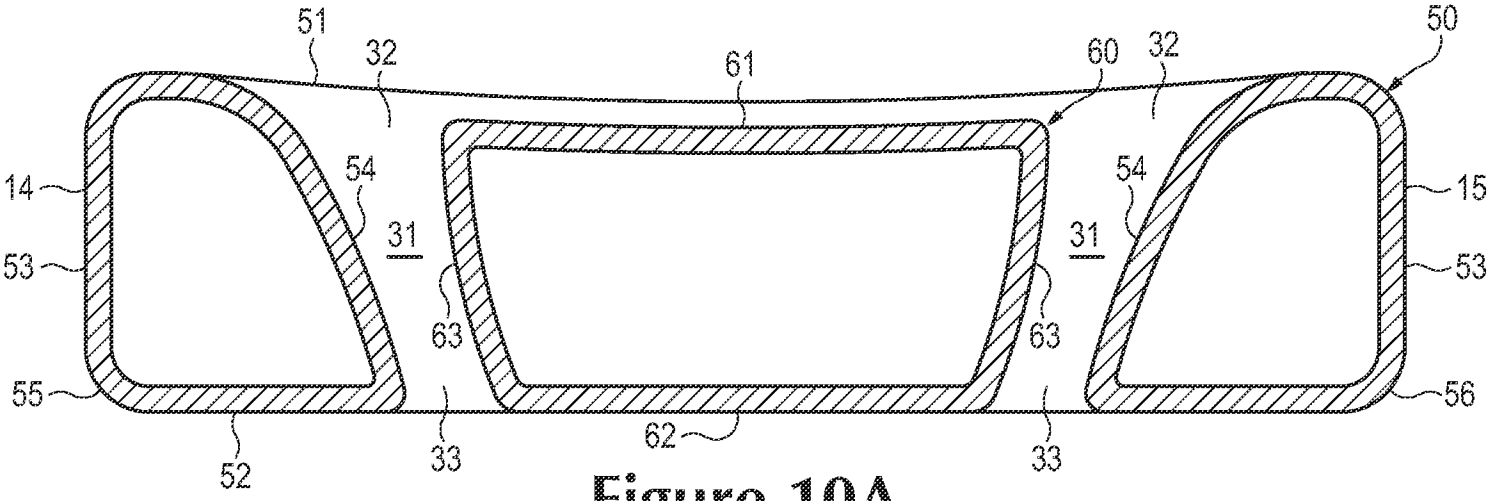
FIGS. 10A and 10B are cross-sectional views of the perimeter chamber and the central chamber, as defined by section lines 10A and 10B in FIG. 7.
Figure 10B:
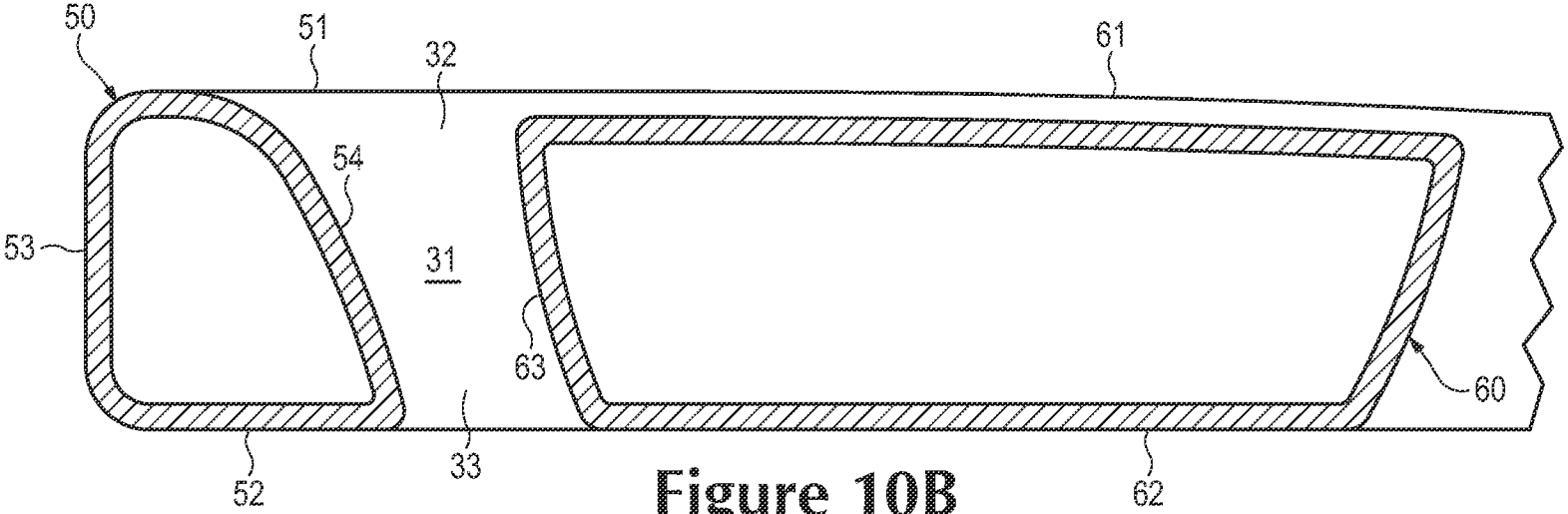

The relative elevations of perimeter chamber 50 and central chamber 60, as well as the configuration of midsole element 40, may form a depression that receives and seats the heel area of the foot. Referring to FIGS. 5A and 5B, for example, upper surfaces 41 of midsole element 40 forms a depression in sole structure 30, and the relative elevations of upper surfaces 51 and 61 correspond with the depression. More particularly, upper surface 51 of perimeter chamber 50 is above or located as a higher elevation than upper surface 61 of central chamber 60. In this configuration, the heel of the foot is seated within sole structure 30, which may enhance the overall stability of footwear 10 during walking, running, or other ambulatory activities.

A wide range of polymer materials may be utilized for chambers 50 and 60. In selecting materials for chambers 50 and 60, engineering properties of the materials (e.g., tensile strength, stretch properties, fatigue characteristics, dynamic modulus, and loss tangent) as well as the ability of the materials to prevent the diffusion of the fluid contained by chambers 50 and 60 may be considered. When formed of thermoplastic urethane, for example, the outer barrier of chambers 50 and 60 may have a thickness of approximately 1.0 millimeter, but the thickness may range from 0.25 to 2.0 millimeters or more, for example. In addition to thermoplastic urethane, examples of polymer materials that may be suitable for chambers 50 and 60 include polyurethane, polyester, polyester polyurethane, and polyether polyurethane. Chambers 50 and 60 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. A variation upon this material may also be utilized, wherein a center layer is formed of ethylene-vinyl alcohol copolymer, layers adjacent to the center layer are formed of thermoplastic polyurethane, and outer layers are formed of a regrind material of thermoplastic polyurethane and ethylene-vinyl alcohol copolymer. Another suitable material for chambers 50 and 60 is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868: and 6,321,465 to Bonk, et al.

The polymer materials forming the exteriors or outer barriers of chambers 50 and 60 enclose a fluid pressurized between zero and three-hundred-fifty kilopascals (i.e., approximately fifty-one pounds per square inch) or more. In addition to air and nitrogen, the fluids contained by chambers 50 and 60 may include octafluorapropane or be any of the gasses disclosed in U.S. Pat. No. 4,340,626 to Rudy, such as hexafluoroethane and sulfur hexafluoride, for example. In some configurations, either or both of chambers 50 and 60 may incorporate a valve that permits adjustment in the pressures of the fluids. Although the pressures of the fluids within chambers 50 and 60 may be the same, a difference in the pressures may be more than 70 kilopascals (i.e., approximately 10 pounds per square inch) in some configurations. For example, the pressure within perimeter chamber 50 may be at least 103.5 kilopascals (i.e., approximately 15 pounds per square inch) above an ambient pressure of air surrounding footwear 10, and the pressure within central chamber 60 may be less than 34.5 kilopascals (approximately 5 pounds per square inch) above the ambient pressure of the air surrounding footwear 10. Although the pressure within perimeter chamber 50 may be greater than the pressure within central chamber 60, the pressures may be equal or the pressure within perimeter chamber 50 may be less than the pressure within central chamber 60.

As discussed above, sole structure 30 may form a depression that receives and seats the heel area of the foot, which is at least partially caused by the relative elevations of upper surfaces 51 and 61, to enhance the overall stability of footwear 10. A further factor that may enhance stability relates to the relative pressures within chambers 50 and 60. Given that perimeter chamber 50 may be pressurized more than central chamber 60, perimeter chamber 50 may be less compressible than central chamber 60. In this configuration, the central area of sole structure 30, which includes central chamber 60, may compress more easily than the peripheral area, which includes perimeter chamber 50. The difference in pressures between chambers 50 and 60 may, therefore, further seat the heel of the foot within sole structure 30, which may further enhance the overall stability of footwear 10 during walking, running, or other ambulatory activities.

Outsole 70 forms a ground-contacting element of footwear 10 and may be formed from a durable and wear-resistant rubber material that includes texturing to impart traction. Outsole 70, which may be absent in some configurations of footwear 10, includes a perimeter section 71 and a central section 72. Perimeter section 71 is secured below perimeter chamber 50, and central section 72 is secured below central chamber 60. More particularly, perimeter section 71 may be secured directly to lower surface 52 of perimeter chamber 50, and central section 72 may be secured directly to lower surface 62 of central chamber 60. Although sections 71 and 72 may be joined in some configurations, sections 71 and 72 are depicted as being separate and spaced elements of outsole 70. When formed as separate and spaced sections of outsole 70, sections 71 and 72 may move independently of each other as chambers 50 and 60 are compressed or otherwise deformed during ambulatory activities.

Gap 31 generally extends between portions of chambers 50 and 60 and through outsole 70. In other words, gap 31 extends upward and into sole structure 30 from a lower surface of outsole 70. Although gap 41 may have a vertical orientation, upper portion 32 of gap 31 is located closer to the sidewall of sole structure 30 than lower portion 33 of gap 31. That is, gap 31 extends in a generally diagonal direction such that lower portion 33 is located closer to a center of sole structure 30 than upper portion 32. In order to impart the diagonal orientation to gap 31, interior side surface 54 of perimeter chamber 50 is sloped and extends toward the central area of sole structure 30, and side surface 63 of central chamber 60 is also sloped toward the central area. More particularly, interior side surface 54 tapers outward between upper surface 51 and lower surface 52, and side surface 63 tapers inward between upper surface 61 and lower surface 62.

Figure 11A:
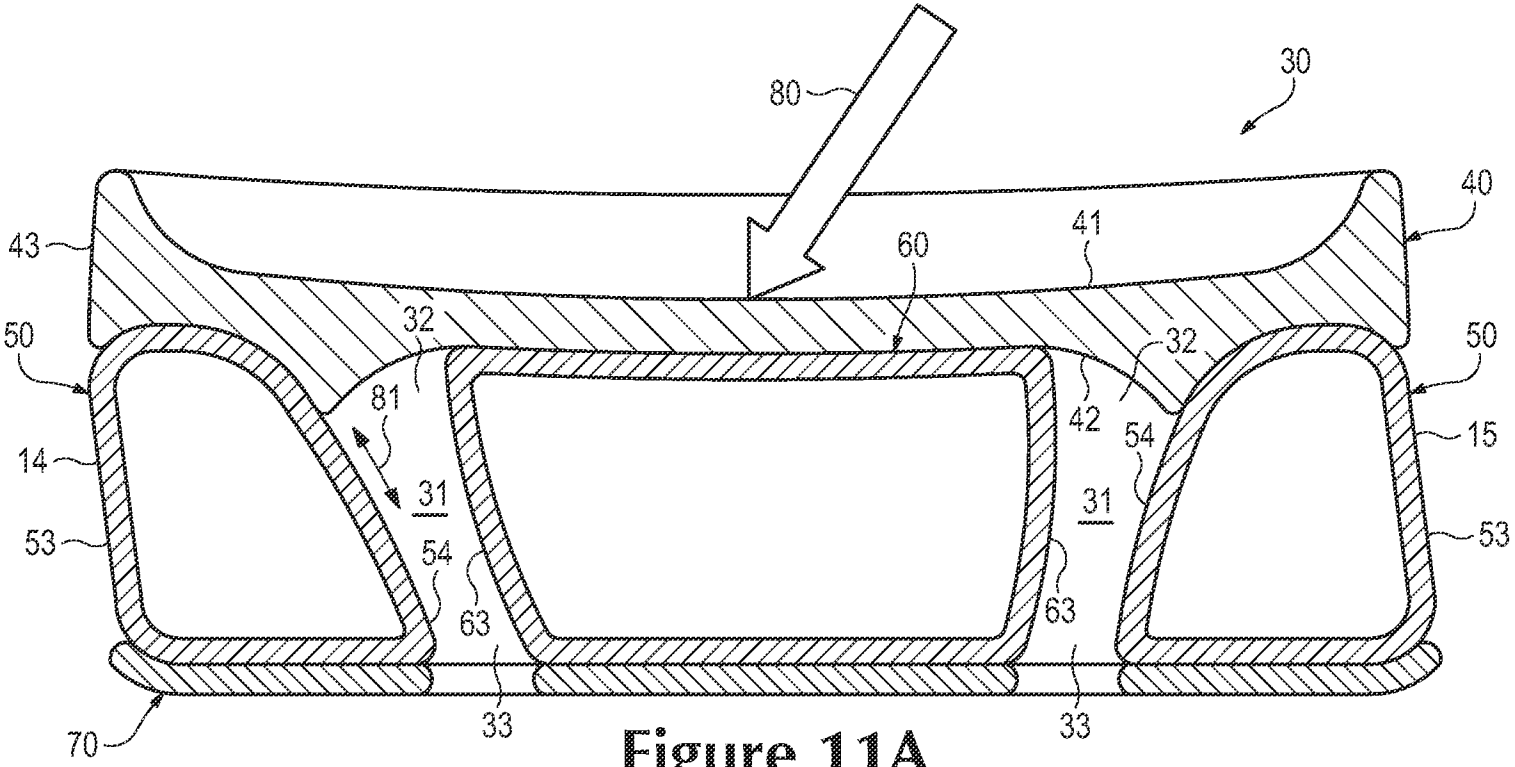
FIGS. 11A and 11B are cross-sectional views corresponding with FIG. 5A and depicting the sole structure when subjected to a compressive force.
Figure 11B:
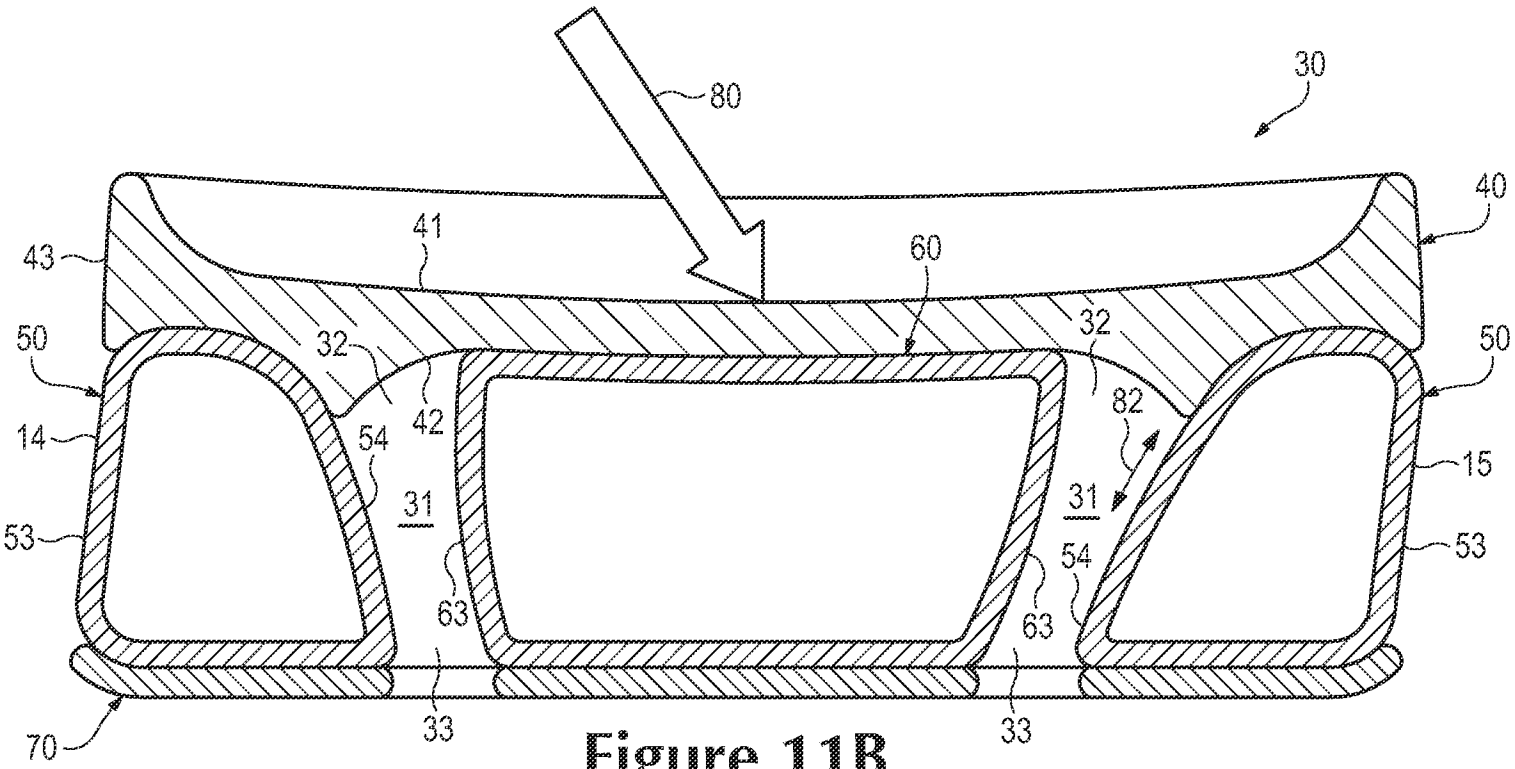

An advantage of the diagonal orientation of gap 31 relates to the stability of footwear 10. Referring to FIG. 11A, a force 80 is shown as compressing sole structure 30 and thrusting toward lateral side 14, which may correspond to a cutting motion that is utilized in many athletic activities to move an individual side-to-side. When force 80 deforms sole structure 30 in this manner, the sloping aspect of interior side surface 54 is placed in tension, as represented by arrow 81. The tension in interior side surface 54 resists the deformation of sole structure 30, thereby resisting the collapse of lateral side 14. Similarly, referring to FIG. 11B, force 80 is shown as compressing sole structure 30 and thrusting toward medial side 15, which may correspond to a pronation motion that occurs during running, for example. When force 80 deforms sole structure 30 in this manner, the sloping aspect of interior side surface 54 is placed in tension, as represented by arrow 82. The tension in interior side surface 54 resists the deformation of sole structure 30, thereby resisting the collapse of medial side 15. The diagonal orientation of gap 31, which is partially due to the slope in interior side surface 54, resists deformation in sole structure 30, thereby enhancing the overall stability of footwear 10 during walking, running, or other ambulatory activities.

Based upon the above discussion, many features of sole structure 30 enhance the overall stability of footwear 10. More particularly, the stability of footwear 10 is enhanced by (a) the depression in sole structure 30 from the relative elevations of upper surfaces 51 and 61 of chambers 50 and 60, (b) the different compressibilities of chambers 50 and 60 from the different pressures of fluids within chambers 50 and 60, and (c) the diagonal orientation of gap 31 from the slope in interior side surface 54 of perimeter chamber 50. While any of these features may be utilized independently to enhance stability, incorporating two or more of the features into sole structure 30 has an advantage of further enhancing the overall stability of footwear 10.

Further Configurations

Figure 12A:
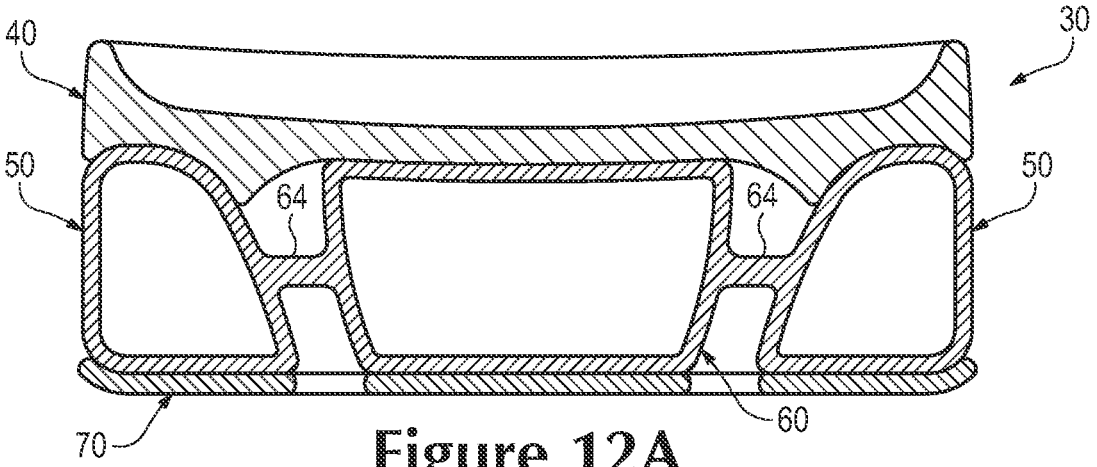
FIGS. 12A-12F are cross-sectional views corresponding with FIG. 5A and depicting further configurations of the sole structure.
Figure 12B:
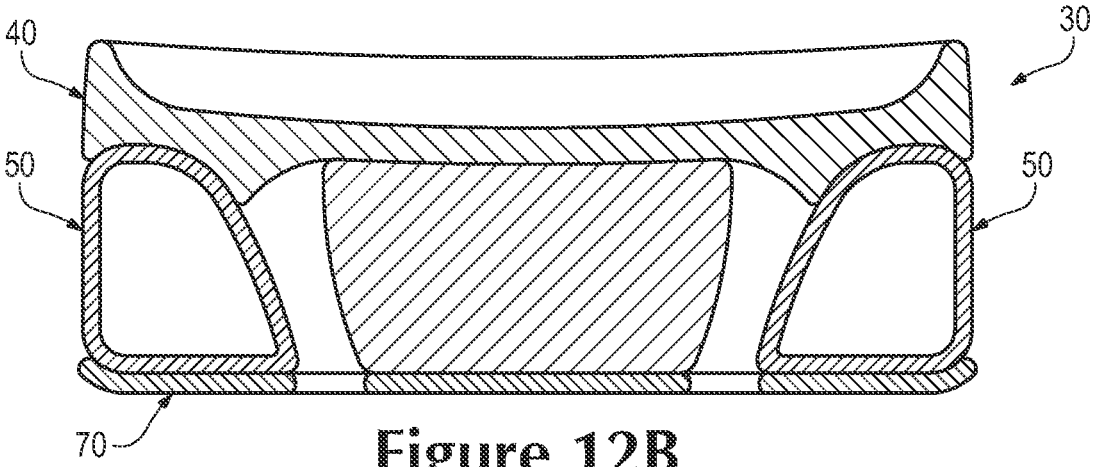
Figure 12C:
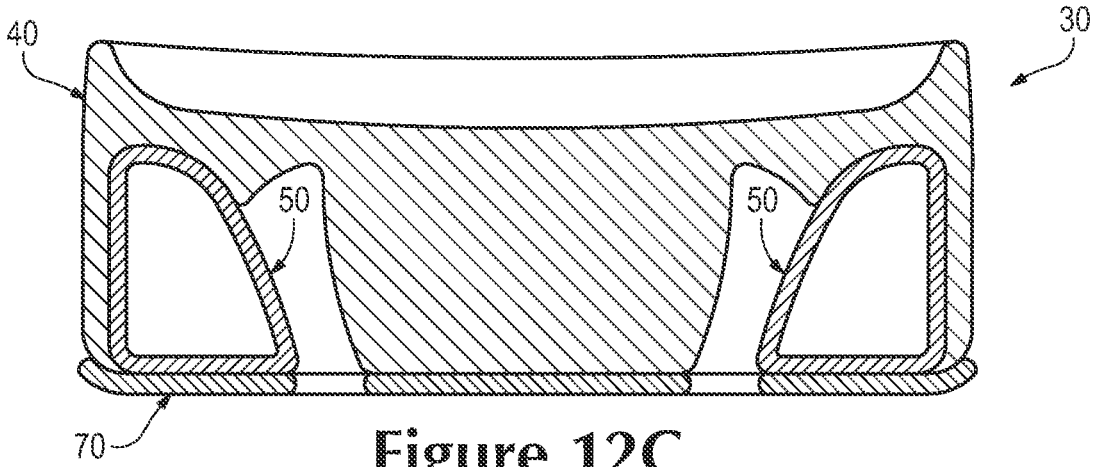
Figure 12D:
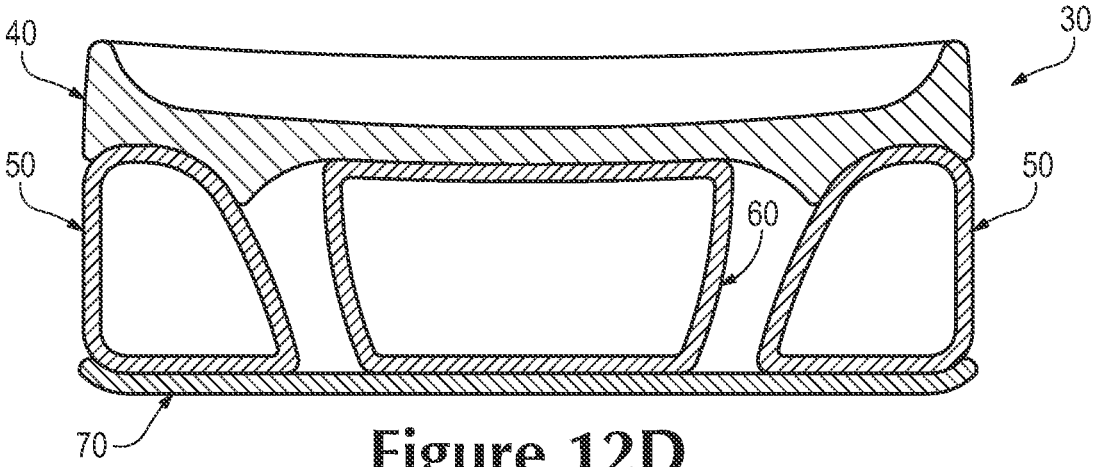
Figure 12E:
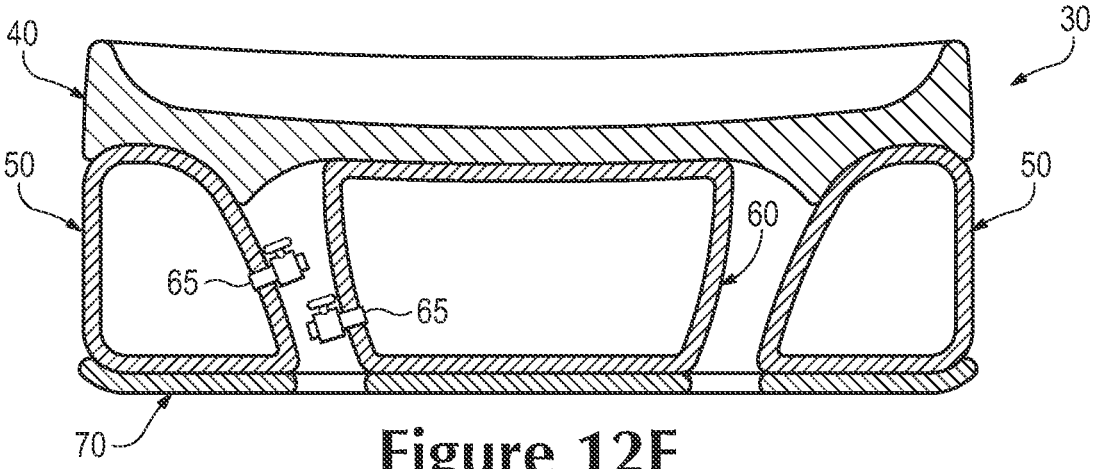
Figure 12F:
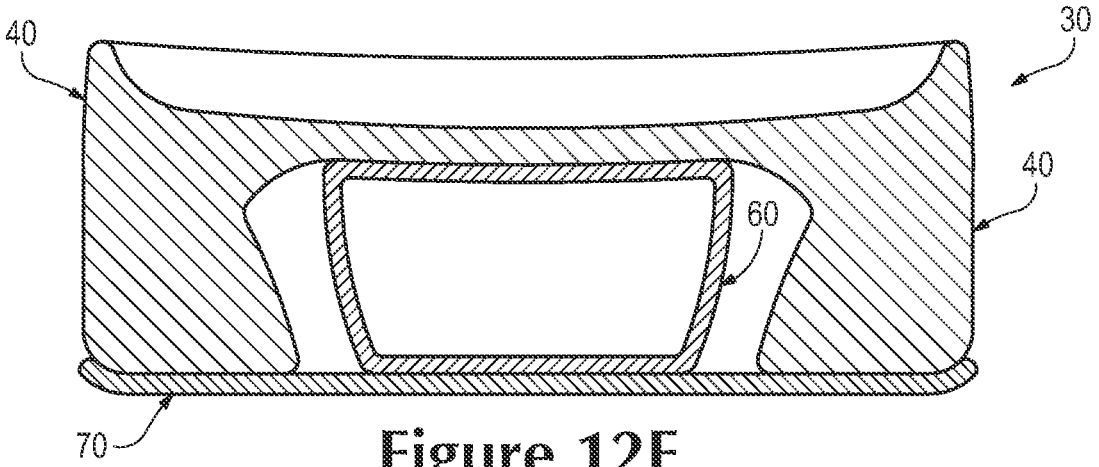

The configuration sole structure 30 discussed above and depicted in the figures provides one example of a suitable configuration for footwear 10. A variety of other configurations, having different features, may also be utilized. Referring to FIG. 12A, for example, chambers 50 and 60 are depicted as being interconnected by tie elements 64, When chambers 50 and 60 are formed to have a one-piece configuration, for example, tie elements 64 may be a web of polymer material that joins chambers 50 and 60 during the manufacturing process. In some configurations, tie elements 64 may also include conduits that allow fluid to pass between chambers 50 and 60. Referring to FIG. 12B, central chamber 60 is depicted as having a solid configuration and may, for example, be a foam element located within the central area of sole structure 30. Central chamber 60 may also be a foam-filled or foam-and-fluid-filled chamber in some configurations. Moreover, perimeter chamber 50 may have a similar solid configuration. Referring to FIG. 12C, sole structure 30 has a configuration wherein midsole element 40 extends over sides of perimeter chamber 50 and also replaces central chamber 60. Referring to FIG. 12D, outsole 70 is formed to have a one-piece configuration that extends over gap 31. Although gap 31 may extend upward and into sole structure 30, outsole 70 may cover gap 31 in some configurations. As another example, FIG. 12E depicts a configuration wherein a pair of valves 65 are associated with chambers 50 and 60, which may allow adjustment of the fluid pressures within chambers 50 and 60. Additionally, perimeter chamber 50 may also be a foam element, as depicted in FIG. 12F, as well as a foam-filled or foam-and-fluid-filled chamber.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

What is claimed is:

1. A sole structure for an article of footwear, the sole structure comprising:

a fluid-filled chamber including an arcuate segment, a first segment extending from the arcuate segment to a first distal end, and a second segment extending from the arcuate segment to a second distal end, an interior surface of the first segment tapering outward between an upper surface and a lower surface of the first segment and tapering from the arcuate segment to the first distal end and an interior surface of the second segment tapering outward between an upper surface and a lower surface of the second segment and tapering from the arcuate segment to the second distal end.

2. The sole structure of claim 1, wherein the first distal end defines the smallest cross-sectional area of the first segment.

3. The sole structure of claim 2, wherein the second distal end defines the smallest cross-sectional area of the second segment.

4. The sole structure of claim 2, wherein the second distal end defines the smallest cross-sectional area of the second segment.

5. The sole structure of claim 1, wherein the fluid-filled chamber includes a substantially U-shape.

6. The sole structure of claim 1, further comprising a cushion disposed between the first segment and the second segment.

7. The sole structure of claim 6, wherein the cushion includes different cushioning characteristics than the fluid-filled chamber.

8. The sole structure of claim 6, wherein the cushion includes a tapered surface that opposes the fluid-filled chamber.

9. The sole structure of claim 1, wherein the fluid-filled chamber is pressurized.

10. An article of footwear incorporating the sole structure of claim 1.

11. A sole structure for an article of footwear, the sole structure comprising:

a fluid-filled chamber including an arcuate segment, a first segment extending from the arcuate segment to a first distal end, and a second segment extending from the arcuate segment to a second distal end, an interior side surface of the first segment tapering outward between an upper surface and a lower surface of the first segment and an interior side surface of the second segment tapering outward between an upper surface and a lower surface of the second segment; and a cushion disposed between the first segment and the second segment, the cushion including different cushioning characteristics than the fluid-filled chamber.

12. The sole structure of claim 11, wherein the first distal end defines the smallest cross-sectional area of the first segment.

13. The sole structure of claim 12, wherein the second distal end defines the smallest cross-sectional area of the second segment.

14. The sole structure of claim 12, wherein the second distal end defines the smallest cross-sectional area of the second segment.

15. The sole structure of claim 11, wherein the fluid-filled chamber includes a substantially U-shape.

16. The sole structure of claim 11, wherein the fluid-filled chamber is disposed in a heel region of the sole structure.

17. The sole structure of claim 16, wherein the cushion is formed from a foam material.

18. The sole structure of claim 17, wherein the cushion includes a tapered surface that opposes the fluid-filled chamber.

19. The sole structure of claim 11, wherein the fluid-filled chamber is pressurized.

20. An article of footwear incorporating the sole structure of claim 11.

* * * * *